US006344834B1

(12) United States Patent
Josypenko

(10) Patent No.: US 6,344,834 B1
(45) Date of Patent: Feb. 5, 2002

(54) LOW ANGLE, HIGH ANGLE QUADRIFILAR HELIX ANTENNA

(75) Inventor: Michael J. Josypenko, Norwich, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/553,146

(22) Filed: Apr. 20, 2000

(51) Int. Cl.[7] ..... H01Q 1/36
(52) U.S. Cl. ..... 343/895
(58) Field of Search ..... 343/895, 749, 343/722, 853; H01Q 1/36

(56) References Cited

U.S. PATENT DOCUMENTS 4,163,981 A * 8/1979 Wilson ..... 343/895
5,444,455 A * 8/1995 Louzir et al. ..... 343/895
5,828,348 A * 10/1998 Tassoudji et al. ..... 343/895
6,075,501 A * 6/2000 Kuramoto et al. ..... 343/895

* cited by examiner

*Primary Examiner*—Michael C. Wimer
(74) *Attorney, Agent, or Firm*—Michael J. McGowan; Prithvi C. Lall; Michael F. Oglo

(57) ABSTRACT

An antenna is provided that can switch from generating a low radiation angle to a high radiation angle. The antenna comprises a quadrifilar helix antenna in which the helical antenna elements have a first pitch at one end of the antenna and a second pitch at the other end of the antenna. Controlling the phase of a driving signal and isolating one section of the antenna are steps that facilitate switching the antenna from generating a pattern with a low elevation angle or high elevation angle.

11 Claims, 8 Drawing Sheets

LOW ANGLE, HIGH ANGLE QUADRIFILAR HELIX ANTENNA

CROSS REFERENCE TO RELATED APPLICATION

U.S. patent application Ser. No. 09/356,803, now U.S. Pat. No. 6,246,379, "Helix Antenna", filed Jul. 19, 1999 by the inventor hereof and assigned to the assignee hereof is incorporated herein by reference.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to antennas and more specifically to quadrifilar antennas.

(2) Description of the Prior Art

Numerous communication networks utilize omnidirectional antenna systems to establish communications between various stations in the network. In some networks one or more stations may be mobile while others may be fixed land-based or satellite stations. Antenna systems that are omnidirectional in a horizontal plane are preferred in such applications because alternative highly directional antenna systems become difficult to apply, particularly at a mobile station that may communicate with both fixed land-based and satellite stations. In such applications it is desirable to provide a horizontally omnidirectional antenna system that is compact yet characterized by a wide bandwidth and a good front-to-back ratio in elevation with circular polarization for satellite communications.

Some prior art omnidirectional antenna systems use an end fed quadrifilar helix antenna for satellite communication and a co-mounted dipole antenna for land based communications. However, each antenna has a limited bandwidth. Collectively their performance can be dependent upon antenna position relative to a ground plane. The dipole antenna has no front-to-back ratio and thus its performance can be severely degraded by heavy reflections when the antenna is mounted on a ship, particularly over low elevation angles. These co-mounted antennas also have spatial requirements that can limit their use in confined areas aboard ships or similar mobile stations.

The following patents disclose helical antennas that exhibit some, but not all, of the previously described desirable characteristics:

U.S. Pat. No. 5,329,287 (1994) Strickland et al.

U.S. Pat. No. 5,489,916 (1996) Waterman et al.

U.S. Pat. No. 5,572,227 (1996) Pal et al.

U.S. Pat. No. 5,604,972 (1997) McCarrick

U.S. Pat. No. 5,612,707 (1997) Vaughn et al.

U.S. Pat. No. 5,329,287 to Strickland discloses a device for use in a helical antenna having an antenna element wound about the periphery of a tubular or cylindrical dielectric support post. The device has an electrically conductive member electrically connected to one end of the antenna element. The conductive member is of any appropriate shape or configuration and is operable to increase the loading on the antenna whereby standing waves on the antenna element are reduced and a more uniform electrical current is produced along the antenna element.

U.S. Pat. No. 5,498,916 to Waterman discloses a quadrifilar helical antenna including four conductive helices having a common central axis, a common direction of turn about said axis, a common pitch and a common length between opposite ends. The helices are uniformly spaced from each other by 90°, with a single dielectric helix concentric with the common axis, lying within and supporting the conductive helices at a nominal diameter. The dielectric helix has opposite ends, a plurality of turns having said common direction of turn, and a second pitch substantially greater than said common pitch. A casing contains the helices and is rotatably fixed to one end of the dielectric helix. A tuning device is fixed to the other end of the dielectric helix and rotatable relative to said casing, so that rotation of the tuning device twists the dielectric helix to alter the common pitch of the conductive helices and thus the elevation patterns of the antenna, without substantial variation from said nominal diameter.

U.S. Pat. No. 5,572,227 to Pal et al. discloses a multiband antenna system for operating at L-band, S-band and UHF-band frequencies. The antenna includes L-band antenna elements and S-band antenna elements provided in the form of quadrifilar helices spaced from each other on the surface of a hollow cylindrical insulator. UHF band antenna elements are provided in the form of a cage dipole on the surface of the hollow cylindrical insulator. The L-band antenna input is connected to a first connector through an L-band feed network card. The S-band antenna input is connected to a second connector through an S-band feed network card and the UHF-band antenna input is connected to a third connector through a split sheath balun provided along the axis of the hollow cylindrical insulator.

U.S. Pat. No. 5,604,972 to McCarrick discloses a mobile vehicular antenna for use in accessing stationary geosynchronous and/or geostable satellites. A multi-turn quadrifilar helix antenna is fed in phase rotation at its base and is provided with a pitch and/or diameter adjustment for the helix elements, causing beam scanning in the elevation plane while remaining relatively omnidirectional in azimuth. The antenna diameter and helical pitch are optimized to reduce the frequency scanning effect. A technique is provided for aiming the antenna to compensate for any remaining frequency scanning effect.

U.S. Pat. No. 5,612,707 to Vaughn et al. discloses a variable helix antenna consisting of one or more conductors affixed to a furled dielectric sheet. The antenna beam is steerable by furling and unfurling of the dielectric sheet either rotationally, axially or by a combination of both. Multiple interleaved dielectric sheets may be used for multifilar embodiments and matching and compensation elements may also be provided on the dielectric sheet.

In addition to the foregoing antennas, there exists a family of quadrifilar helixes that are broadband impedance wise above a certain "cut-in" frequency, and thus are useful for wideband satellite communications including SATCOM (Satellite Communications) and Demand Assigned Multiple Access (DAMA) UHF functions in the range of 240 to 320 MHz and for other satellite communications functions in the range of 320 to 410 MHz. For example, my above-identified pending U.S. patent application Ser. No. 09/356,808 discloses an antenna having four constant-width antenna elements wrapped about the periphery of a cylindrical support. This construction provides a broadband antenna with a bandwidth of 240 to at least 400 MHz and with an input impedance in a normal range, e.g., 100 ohms. This antenna also exhibits a good front-to-back ratio in both open-ended and shorted configurations. In this antenna, each antenna element has a width corresponding to about 95% of the available width for that element.

Typically these antennas have (1) a pitch angle of the elements on the helix cylindrical surface from 50° down to roughly 20°, (2) elements that are at least roughly ¾ wavelengths long, and (3) a "cut-in" frequency roughly corresponding to a frequency at which a wavelength is twice the length of one turn of the antenna element. This dependence changes with pitch angle. Above the "cut-in" frequency, the helix has an approximately flat VSWR around 2:1 or less (about the $Z_o$ value of the antenna). Thus the antenna is broadband impedance-wise above the cut-in frequency. The previous three dimensions translate into a helix diameter of 0.1 to 0.2 wavelengths at the cut-in frequency.

For pitch angles of approximately 30° to 50°, such antennas provide good cardioid shaped patterns for satellite communications. Good circular polarization exists down to the horizon since the antenna is greater than 1.5 wavelengths long (2 elements constitute one array of the dual array, quadrifilar antenna) and is at least one turn. At the cut-in frequency, lower angled helixes have sharper patterns. As frequency increases, patterns start to flatten overhead and spread out near the horizon. For a given satellite band to be covered, a tradeoff can be chosen on how sharp the pattern is allowed to be at the bottom of the band and how much it can be spread out by the time the top of the band is reached. This tradeoff is made by choosing where the band should start relative to the cut-in frequency and the pitch angle.

For optimum front-to-back ratio performance, the bottom of the band should start at the cut-in frequency. This is because, for a given element thickness, backside radiation increases with frequency (the front-to-back ratio decreases with frequency). This decrease of front-to-back ratio with frequency limits the antenna immunity to multipath nulling effects.

SUMMARY OF THE INVENTION

Therefore it is an object of this invention to provide a broadband unidirectional hemispherical coverage antenna.

Another object of this invention is to provide a broadband unidirectional hemispherical coverage antenna with good front-to-back ratio.

Yet another object of this invention is to provide a broadband unidirectional hemispherical coverage antenna that operates with circular polarization.

Yet still another object of this invention is to provide a broadband unidirectional hemispherical coverage antenna that operates with a circular polarization and that exhibits a good front-to-back ratio.

Yet still another object of this invention is to provide a broadband unidirectional hemispherical coverage antenna that is simple to construct and is lightweight.

A further object of this invention is to provide a broadband unidirectional hemispherical coverage antenna having low and high angle patterns.

An antenna constructed in accordance with one aspect of this invention connects to an rf source and includes a plurality of antenna elements. Each antenna element has a helical form extending along an antenna axis and is spaced from others of said antenna elements. Each antenna element has a first pitch angle relative to a plane normal to the antenna axis at a first end and a greater pitch angle at its second end. Rf feed points can be selected at either end of said antenna. The connection of the rf source to the selected rf feed points at one end of said antenna determines the operation said antenna as a low-angle or high-angle antenna.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
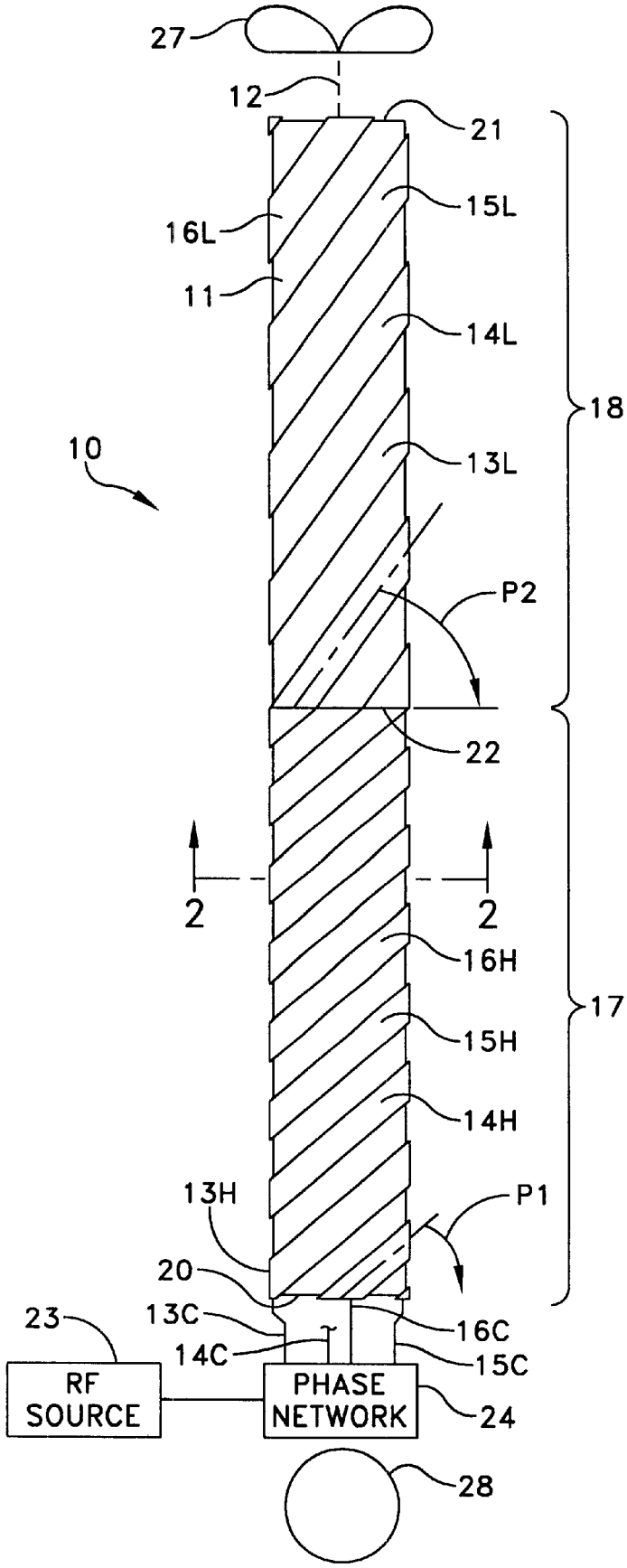
FIG. 1 is an elevation view of one embodiment of a quadrifilar helix antenna constructed in accordance with this invention.
Figure 2:
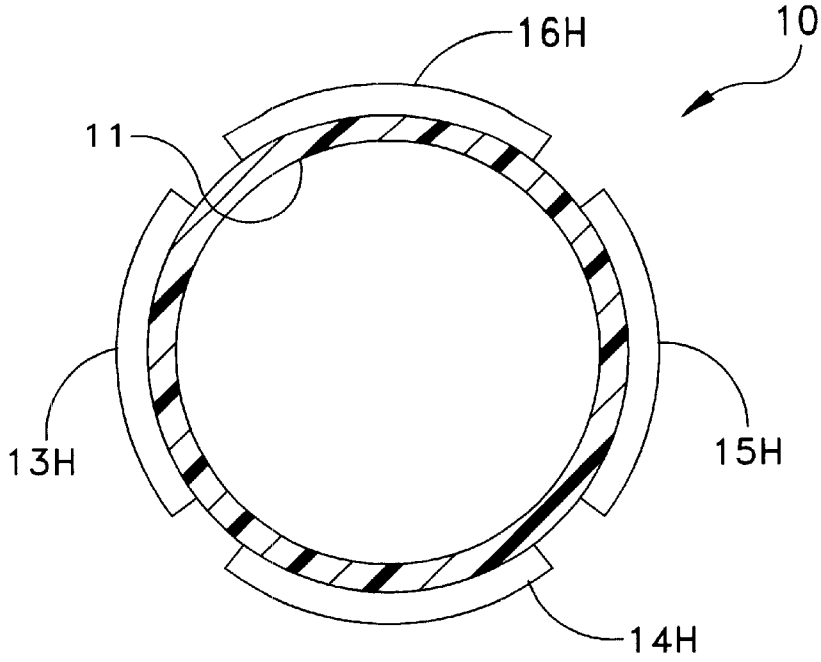
FIG. 2 is a cross-section taken along lines 2—2 in FIG. 1.
Figure 3:
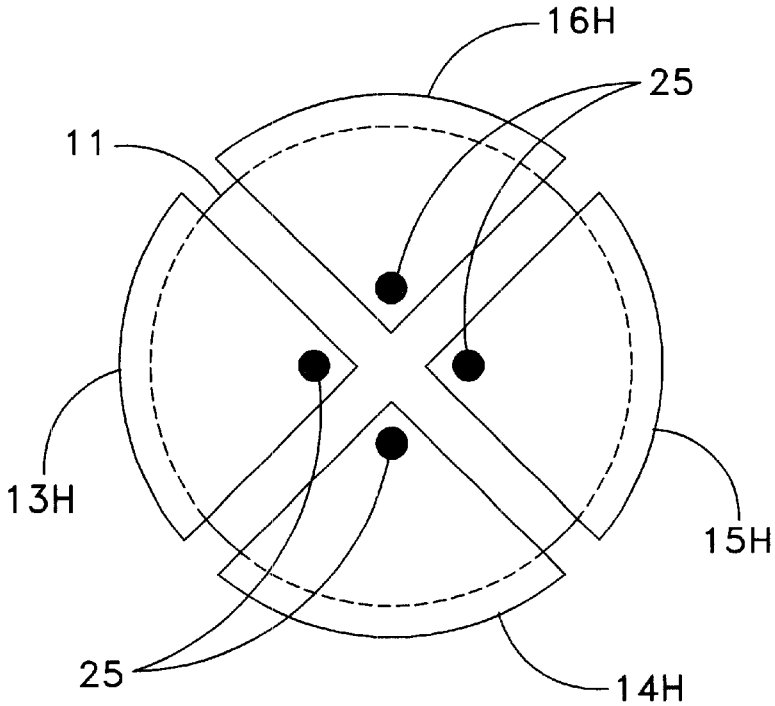
FIG. 3 is a bottom view of the antenna shown in FIG. 1.

FIGS. 1 through 3 depict an RF antenna 10 constructed in accordance with this invention that includes a quadrifilar helix antenna with special characteristics formed on a support tube 11. The support tube 11 is an optional component and can be eliminated if the antenna elements are formed in a self-supporting manner; alternatively, other support structures might be substituted for the supporting tube 11.

The antenna 10 extends along an axis 12 and includes four antenna elements. These antenna elements are identified by reference numerals 13H, 14H, 15H and 16H in a high elevation angle radiation section 17 and by reference numerals 13L, 14L, 15L and 16L in a low elevation angle radiation section 18. In the orientation shown in FIG. 1, the antenna 10 has a first end 20 that constitutes a bottom end and a second end 21 that is a top end. An intermediate plane 22 divides the antenna 10 into the high elevation angle radiation section 17 and low elevation angle radiation section 18. In the high elevation angle radiation section 17 the antenna elements 13H through 16H wrap in a helix that has a first pitch designated P1. The angle P1 has a value less than 50° in order to provide the high elevation angle radiation. Similarly, the antenna elements 13L through 16L in the low elevation angle radiation section 18 are wrapped with a pitch P2. The pitch P2 is greater than 50° to provide the low elevation angle radiation.

In use, an RF source 23 supplies an RF signal to a phase network 24. The phase network then drives the individual antenna elements in phase quadrature through connections to feedpoints 25, shown more particularly in FIG. 3. The feedpoints are placed on extensions of each of the antenna elements 13H through 16H that are bent over end 20 of antenna 10 to lie in a plane transverse to the axis 12. More specifically, a typical phase network 24 provides a phase quadrature output to the RF antenna 10. Such phase networks are known in the art and operate by having the RF signal from the RF source 23 applied to a 90° power splitter in which a dump port is terminated in a characteristic impedance, e. g. $Z_0$=50. The two outputs of the 90° power splitter go to the inputs of two 180° power splitters. The four output signals from the 180° power splitters then are fed through the center conduct equal length cables 13C through 16C to the feedpoints 25 on the individual ones of the antenna elements 13H through 16H, respectively as known in art. In one phase rotation the antenna operates in a forward mode of radiation. Reversing output cables of the 90° power splitter causes the antenna to operate in a backfire mode of radiation.

It is also possible the structure shown in FIG. 3 can be applied at the top end 21 of the antenna 10. That is, that the antenna elements 13L through 16L can be bent over the top end 21 in a plane transverse to the antenna axis 12 and terminated with feed positions, such as the feed positions 25 in FIG. 3.

The ability to feed the antenna from either the bottom end 20 or the top end 21 and to provide operation in a backfire or forward fire mode provides four possible sets of patterns. If the phase network 24 energizes the antenna in a forward fire mode from the bottom end 20, the antenna radiates a low angle pattern 27 from the top of the antenna. If antenna 10 is operated in a back fire mode, a high angle pattern 28 radiates from the bottom of the antenna 10. Reversing the feedpoint reverses the pattern. That is, if the phase network 24 energizes the antenna from the top end 21, a forward fire operating mode produces the high angle pattern 28 from bottom end 20 while the backward fire mode produces the low angle pattern 27 from top end 21.

An antenna having the following specific characteristics has been constructed:

| Parameter | Value |
|---|---|
| Mode of operation | Backfire or torward fire |
| Impedance at antenna end | Open |
| Feed network | Phase quadrature as shown in FIG. 1 |
| Helix cylinder diameter | 5.5" |
| Cylinder length | 30" for high angle section 17<br>37.5 for low angle section 18 |
| Element material | Wide copper tape |
| Element width | Approximately 50% of available space |
| Pitch angle | 40.96° for the high angle section 17<br>66.64° for the low angle section 18 |

Essentially the resultant patterns follow closely the patterns of the individual helices by themselves as represented by the high angle radiation section 17 and the low angle radiation section 18. FIGS. 4A through 4K show the resultant patterns. The patterns designated with reference numeral 30 are the high angle radiation patterns emanating from the bottom of the antenna 10 with the antenna 10 configured as shown in FIG. 1 fed in the back fire mode while the patterns 31 represent the radiation from the top of the antenna when the antenna was fired in a forward fire mode.

Figure 4B:
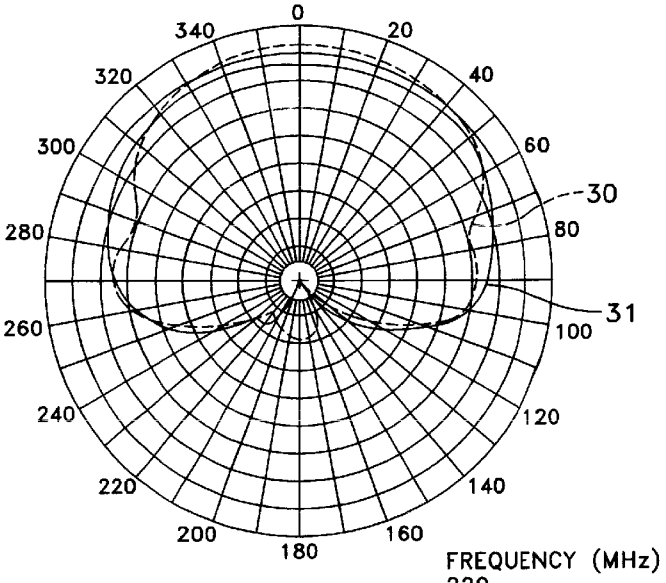
FIGS. 4A through 4K depict gains achieved by the antenna shown in FIG. 1.
Figure 4A:
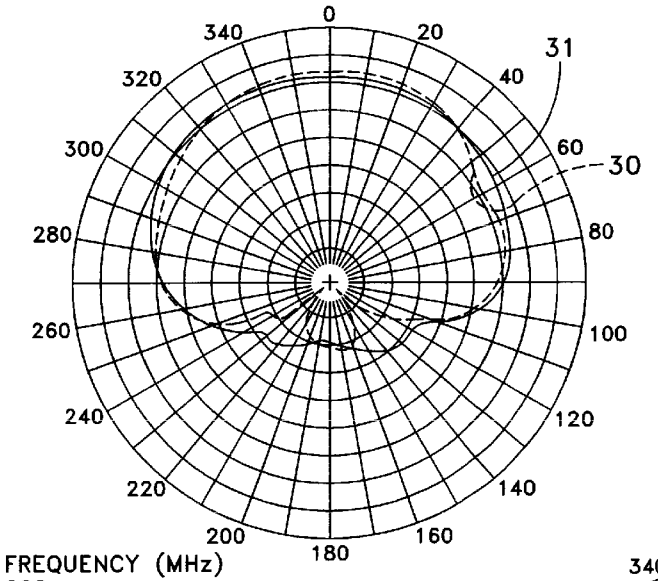
Figure 4C:
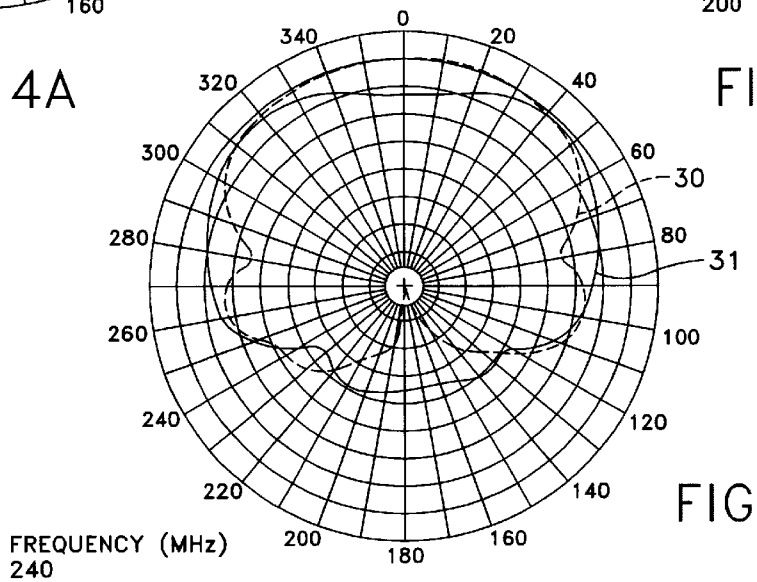
Figure 4D:
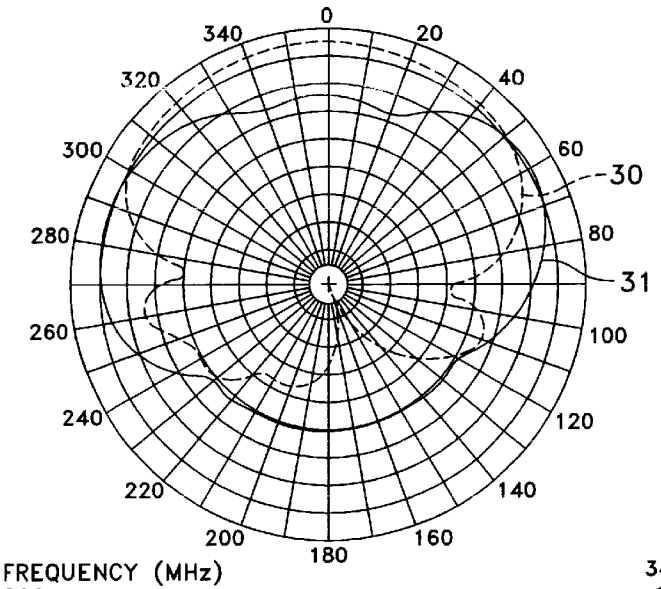
Figure 4E:
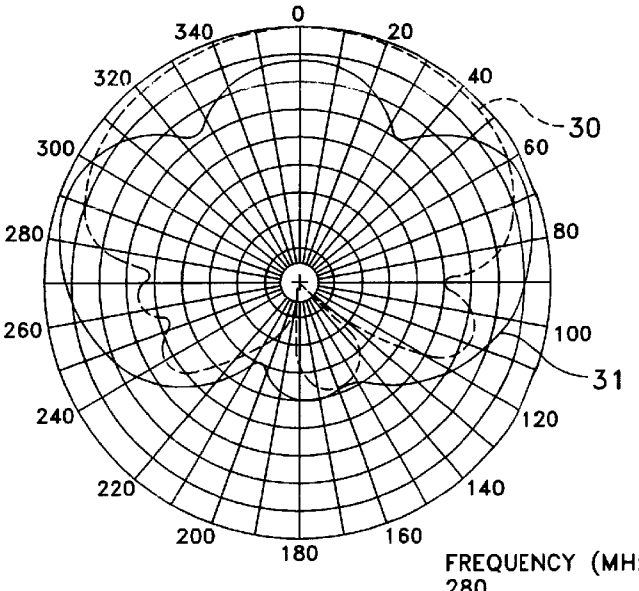
Figure 4F:
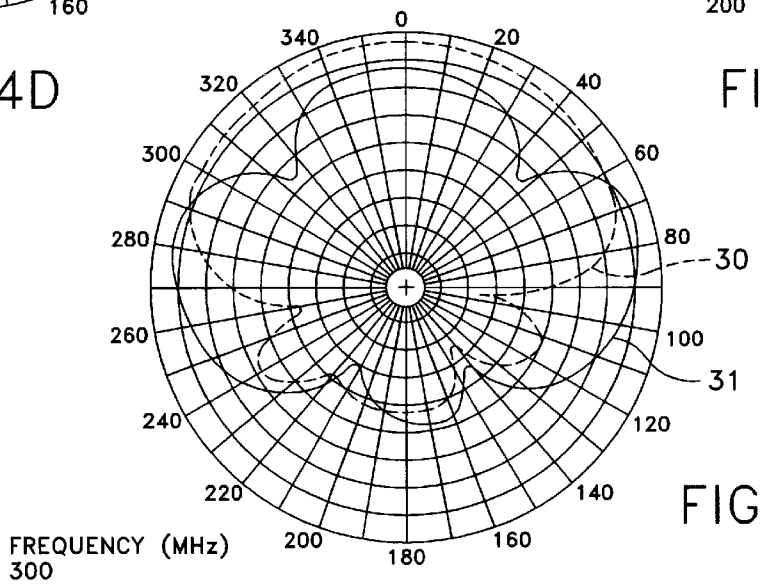
Figure 4H:
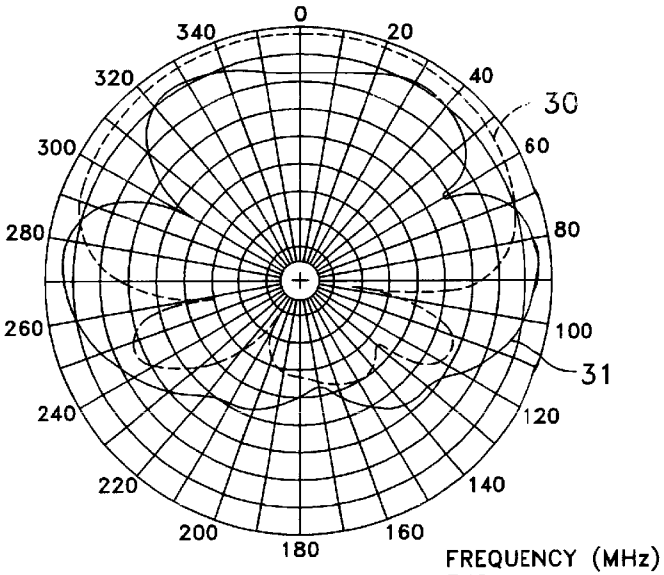
Figure 4G:
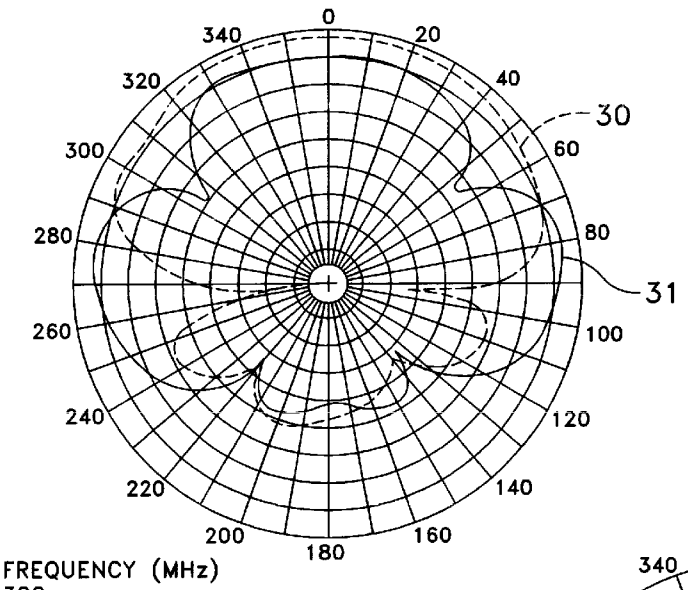
Figure 4I:
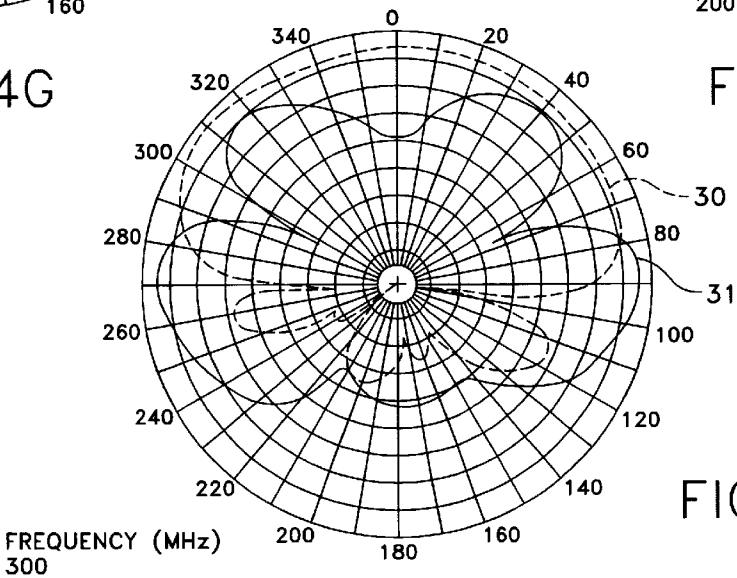
Figure 4K:
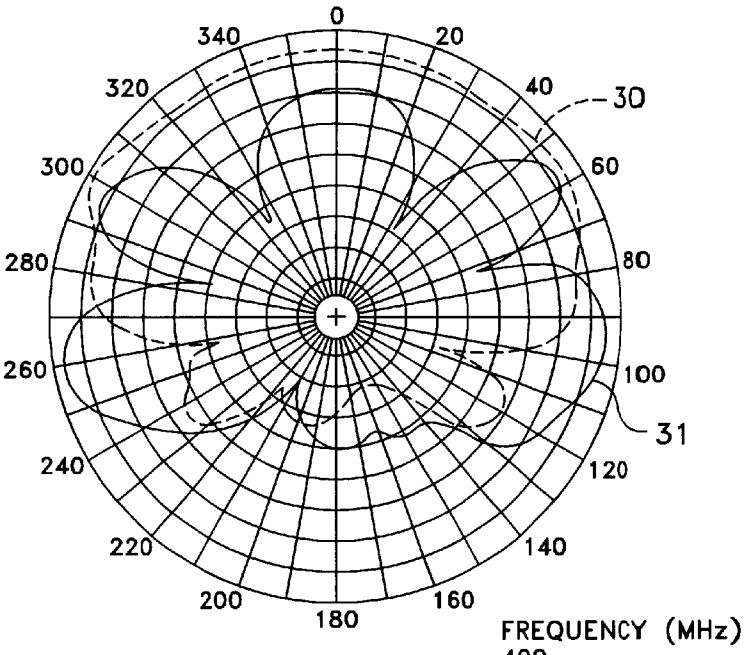
Figure 4J:
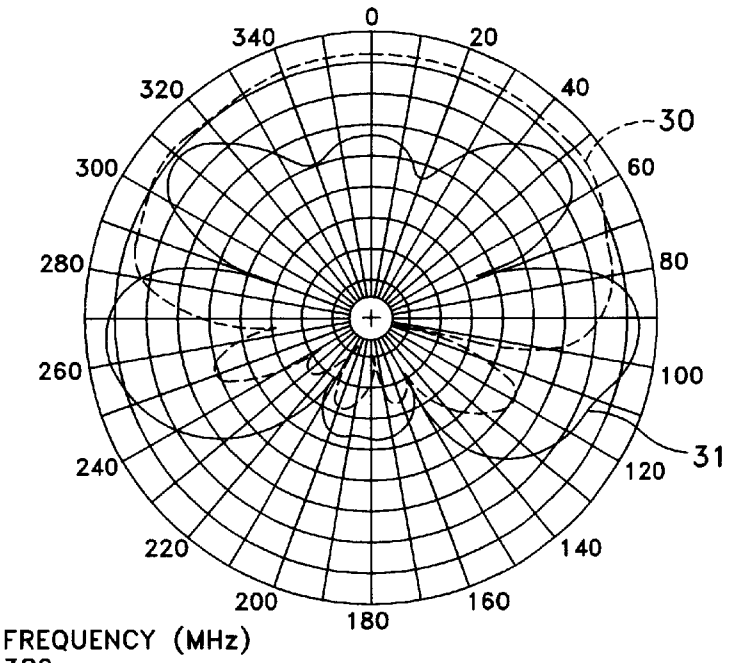

The patterns 30 and 31 are closely matched in FIG. 4A, but begin to differentiate into low and high elevation patterns at about 220 MHz as shown in FIG. 4B. The the pattern shapes indicate that this particular antenna is slightly too small for a DAMA band in which the bottom frequency range is 240 MHz. Increasing the antenna size would overcome this problem.

Above the 240 MHz frequencies as shown in FIGS. 4D through 4K, the two patterns differentiate. Moreover, the following characteristics of an antenna incorporating this invention have been found to exist. First, the low angle radiation section 18 should be appreciably longer than ¾ wavelengths in order to obtain a reasonable amount of splitting of the pattern overhead and forcing the pattern out toward the horizon.

Second, there should be a minimum distance, in terms of wavelengths, separating the high and low angle radiation sections 17 and 18 in order for the patterns to start to differentiate into high elevation and low elevation patterns. This means that the antenna should be of minimum length.

Third, energizing the antenna in a backward fire or forward fire mode for a given set of patterns produces little change in the patterns.

For maximum power transfer to or from an antenna, the antenna must have a low VSWR. In the embodiment shown in FIG. 1, the high angle radiation section 17 is fed first and thus the VSWR of the antenna will be at least the VSWR of this section. Any additional radiation from the low angle radiation section 18 will improve, or lower, the VSWR. As is known in the art, the high angle radiation section 17, by itself, is a broad band, low VSWR antenna (above a cut in frequency), and thus can be considered as a high loss attenuator and the resultant antenna VSWR will be low. If the antenna is fed from the top 21, the low angle radiation, higher VSWR section 18 is fed first. Additional radiation by the low VSWR high angle radiation section 17 will improve the match to a match that is better than that of the high angle radiation section 17 by itself. Thus in this environment the high angle radiation section 17 can be looked upon as a high loss termination.

Figure 5:
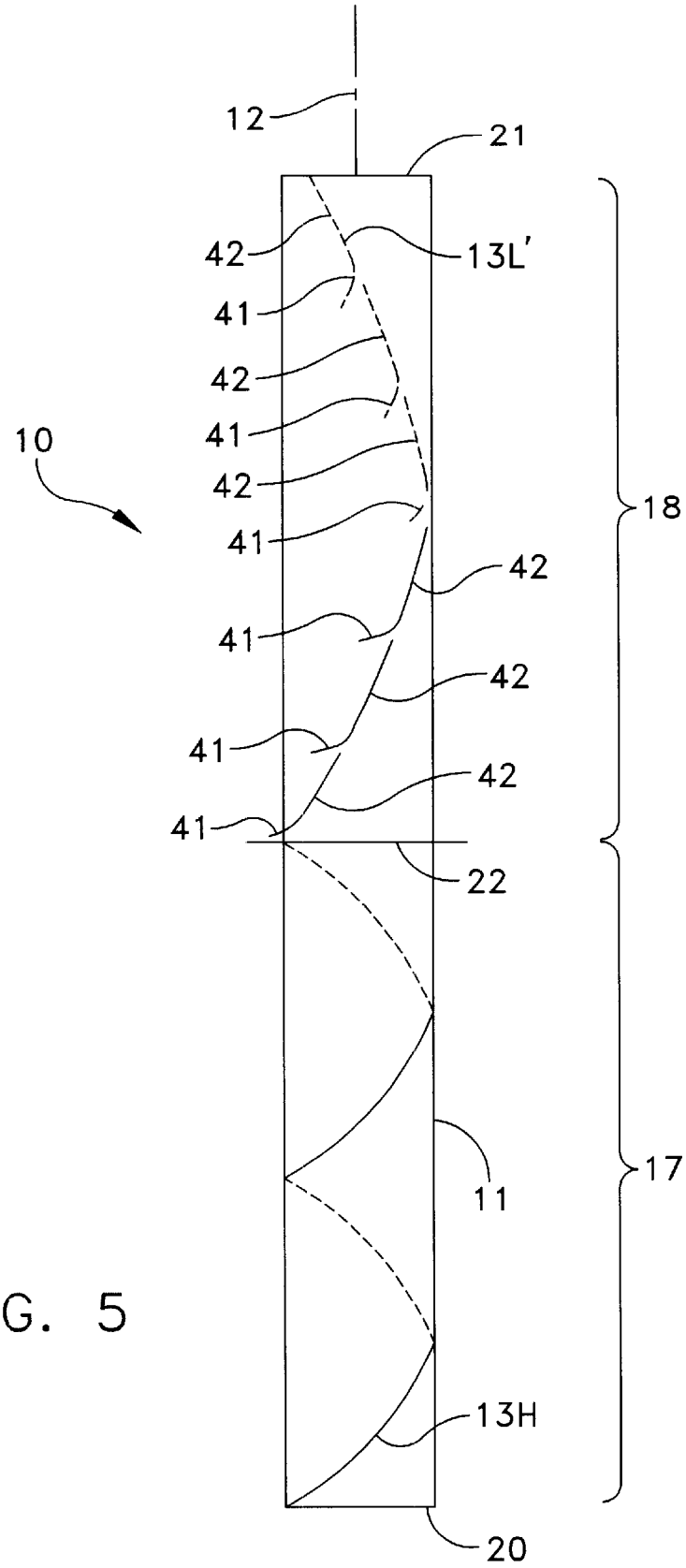
FIG. 5 is a schematic view of an alternate embodiment of an antenna constructed in accordance with this invention.

As previously indicated, different operating modes can occur. If one wanted to switch from one set of patterns to another set in the same direction one would either have to physically rotate the antenna 10 180° and modify the operation of the phase network 24 to change the antenna feed mode between the forward fire and backward fire positions operating modes. While the latter can be accomplished in a practical matter, the former cannot. FIG. 5 depicts an alternative embodiment of the antenna 10 with only antenna elements 13H and 13L' shown and depicted as a single line for clarity. Specifically, the antenna elements 13H—13L' wrap around the dielectric tube 11. Like FIG. 1, the antenna 10 extends along an antenna axis 12 from the bottom end 20 to the top end 21, with the pitch of the winding 13H—13L' changing at an intermediate plane 22. The antenna element 13H of FIG. 5 has the same construction as the antenna element 13H in FIG. 1.

In FIG. 5, the antenna element 13L' has a different construction than that of element 13L of FIG. 1. A plurality of switches 41 are spaced along the length of the winding 13L'. When the mechanical or electrical switches 41 are closed, the conductive path operates in the same fashion as the element 13L in FIG. 1. However, when all the switches are opened simultaneously, the effective length of individual segments, such as segments 42, are limited to less than ⅛ wavelength at the highest operating frequency so that the segments 42 are electrically short, being of high impedance and, effectively, are thus electrically transparent. When this occurs the low angle radiation section 18 extending from the intermediate plane 22 to the top 21 will not redirect radiation of the high angle radiation section 17 into low angle radiation patterns. The resultant antenna as shown in FIG. 5 then limits the antenna to radiating from the section 17 thereby to provide a high angle radiation pattern and to provide a low VSWR. For both low and high elevation angle patterns, the antenna is fired in the forward fire mode. Thus, the embodiment of FIG. 5 provides both sets of patterns without rotating antenna 10 or modifying the operation of phase network 24.

Figure 6:
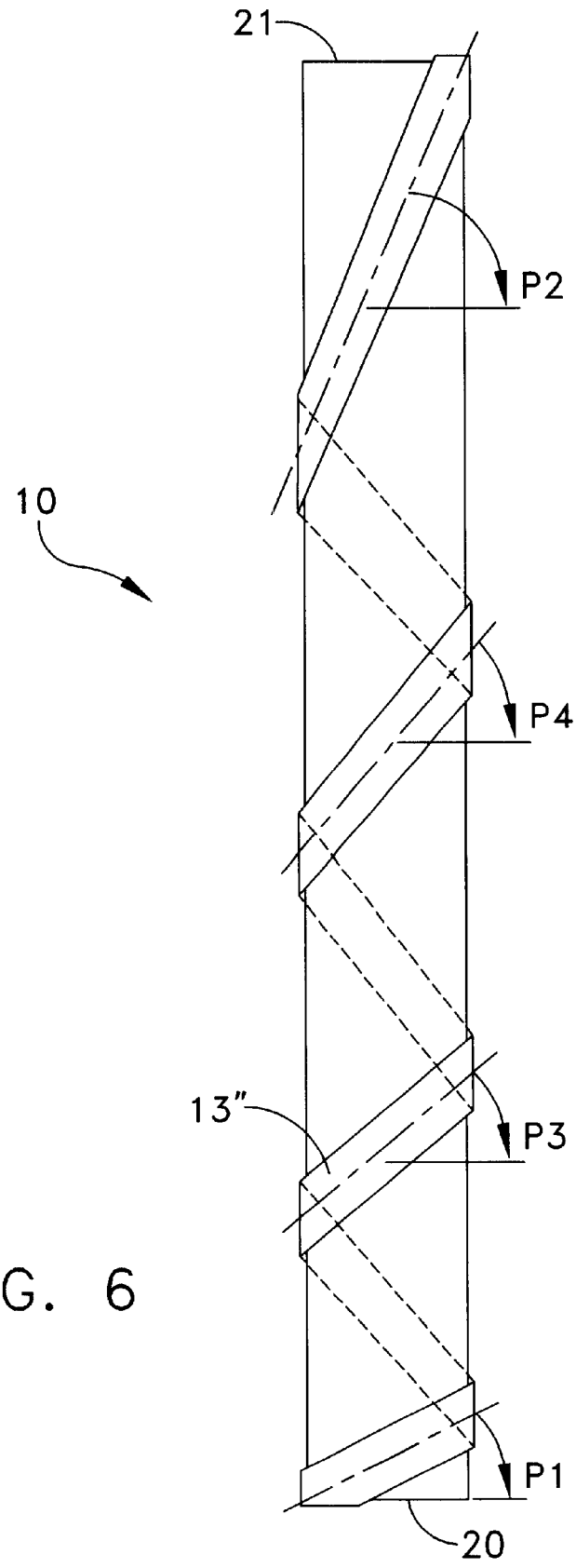
FIG. 6 is a schematic view of another embodiment of an antenna constructed in accordance with this invention.

In FIGS. 1 and 5, there is a discrete pitch angle change at the mid plane 22 from pitch angle P1 to pitch angle P2. FIG. 6 depicts another alternative embodiment that eliminates this discrete pitch angle change at the plane 22 by providing a continuous change of pitch angle between a minimum pitch angle Pi at the bottom end 21 of the antenna 10 for high radiation angle patterns and a maximum pitch angle P2 at the top end 21 of the antenna 10 for lower radiation angle patterns. For clarity, FIG. 6 depicts only a single element 13" of the four helical elements which would comprise antenna 10. This element 13" has a continuously increasing pitch angle starting at P1 at end 20 and increasing to a maximum pitch angle P2 at the top end 21. At intermediate positions, the antenna element 13" has a pitch angle P3 and P4, such that P1<P3<P4<P2. In one embodiment P1=40°, increasing to P2=90° at the top end 21 of the antenna 10. The pitch angle may be made to increase linearly or exponentially from bottom end 20 to top end 21.

An antenna constructed with this continuously changing pitch from the minimum pitch at P1 to a maximum pitch at P2 showed somewhat more distinctive low and high elevation radiation angle patterns. At higher frequencies, such as the frequencies of FIGS. 4E through 4K, at which the equivalent low angle radiation section of one pitch angle is past ¾ wavelengths long and the radiation pattern is multilobing, high elevation angle radiation patterns have slightly less ripple near the horizon and low elevation angle radiation patterns have slightly less radiation overhead.

In each of these embodiments, an antenna is provided having broadband impedance matching and capable of either low elevation angle or high elevation angle radiation patterns that are useful for satellite communication. Moreover, the switching in each of these antennas can be easily accomplished by changing the phase of the feed network and by either rotating the antenna to 180° in elevation or by segmenting the low angle radiation angle section so that it is effectively removed from the antenna for high angle patterns. It will be apparent that many modifications can be made to the specifically disclosed embodiments. For example, the width of the antenna elements may be selected to optimize impedance matching. It is known that a width of 95% of available space provides a better match, as shown in my above-identified pending U.S. patent application 09/356,803; for example, an impedance of 100 ohms which matches the 100 ohms across a 50-ohm, 180° power splitter. Similarly, alternate structures such as tubular or solid or wire elements might be substituted for the strips shown in the individual figures. Pitch angles, other than those specifically disclosed, could be incorporated. Still other modifications and variations could all be made without adversely effecting the operation of such an antenna and without departing from the true scope of this invention. Therefore, it is the intent of the appended claims to cover all such variations and modifications as come within the scope of this invention.

What is claimed is:

1. A quadrifilar antenna for connection to an rf source comprising:

a plurality of antenna elements each being formed helically about and along an antenna axis and being spaced from others of said antenna elements, each antenna element having a first portion formed with a first pitch angle relative to a plane normal to the antenna axis at a first end and having a second portion formed with a second pitch angle at a second end, the second pitch angle being greater than the first pitch angle; and rf feed points on at least one of the first and second ends, the connection of the rf source to the selected rf feed points at one end determining the operation of said antenna as a low or high elevation angle antenna whereby said antenna constitutes a single quadrifilar helix antenna that operates over a wide frequency band.

2. An antenna as recited in claim 1 wherein said rf source generates differently phased signals during forward fire and backfire operation modes to said rf feed points at said first end, said antenna producing a high elevation angle radiation pattern extending from said first end in the backfire operating mode, said antenna producing a low elevation angle radiation pattern extending from said second end in the forward fire operating mode.

3. An antenna as recited in claim 1 wherein said rf source generates differently phased signals during forward fire and backfire operation modes to said rf feed points at said second end, said antenna producing a high elevation angle radiation pattern extending from said first end in the forward fire operating mode, said antenna producing a low elevation angle radiation pattern extending from said second end in the backfire operating mode.

4. An antenna as recited in claim 2 wherein the pitch of said antenna elements at the first end of the antenna is less than 50° and the pitch of the antenna elements at the second end of the antenna is greater than 50°.

5. An antenna as recited in claim 1 wherein the pitch of said antenna elements at the first end of the antenna is less than 50° and the pitch of the antenna elements at the second end of the antenna is greater than 50°.

6. An antenna as recited in claim 1 wherein each said second portion of each said antenna element includes:

a plurality of antenna segments; and a plurality of switches connecting said antenna segments in series when said switches are conductive.

7. An antenna as recited in claim 6 wherein said rf feed points are at said first end to connect to the rf source producing a forward mode signal sequence, said antenna radiating a low elevation angle radiation pattern from said second end when said switches are conductive, said antenna radiating a high elevation angle radiation pattern from the second end when said switches are not conductive.

8. An antenna as recited in claim 6 wherein the antenna operates with a maximum operating frequency and each of said antenna segments has a length that is less than ⅛ wavelength at the maximum operating frequency.

9. An antenna as recited in claim 1 wherein said pitch varies continuously from a minimum value at said first end to a maximum value at said second end.

10. An antenna as recited in claim 1 wherein said pitch varies exponentially from a minimum value at said first end to a maximum value at said second end.

11. An antenna as recited in claim 1 wherein said pitch varies continuously from a minimum value of about 40° at said first end to a maximum of about 90° at said second end.

* * * * *